US011377970B2

(12) United States Patent
Folkers et al.

(10) Patent No.: US 11,377,970 B2
(45) Date of Patent: Jul. 5, 2022

(54) SYSTEM AND METHOD FOR PROVIDING COMPRESSED AIR TO A GAS TURBINE COMBUSTOR

(71) Applicant: Chromalloy Gas Turbine LLC, Palm Beach Gardens, FL (US)

(72) Inventors: Daniel L. Folkers, Stuart, FL (US); Zhenhua Xiao, West Palm Beach, FL (US); Vincent C. Martling, Wellington, FL (US)

(73) Assignee: Chromalloy Gas Turbine LLC, Palm Beach Gardens, FL (US)

( * ) Notice: Subject to any disclaimer, the term of this patent is extended or adjusted under 35 U.S.C. 154(b) by 216 days.

(21) Appl. No.: 16/178,768

(22) Filed: Nov. 2, 2018

(65) Prior Publication Data

US 2020/0141252 A1 May 7, 2020

(51) Int. Cl.

| | |
|---|---|
| ***F01D 9/02*** | (2006.01) |
| ***F23R 3/14*** | (2006.01) |
| ***F23R 3/50*** | (2006.01) |

(52) U.S. Cl.

CPC ..... *F01D 9/023* (2013.01); *F23R 3/14* (2013.01); *F23R 3/50* (2013.01); *F05D 2240/35* (2013.01); *F05D 2260/201* (2013.01); *F23R 2900/03043* (2013.01); *F23R 2900/03044* (2013.01)

(58) Field of Classification Search

CPC .... F01D 9/023; F23R 3/02; F23R 3/04; F23R 3/14; F23R 3/16; F23R 3/42; F23R 3/425; F23R 3/44; F23R 3/46; F23R 3/58

See application file for complete search history.

(56) References Cited

U.S. PATENT DOCUMENTS

| | | | | |
|---|---|---|---|---|
| 5,749,218 | A | 5/1998 | Cromer et al. | |
| 6,216,442 | B1 | 4/2001 | Belsom et al. | |
| 6,279,313 | B1 | 8/2001 | Lawen, Jr. et al. | |
| 6,430,932 | B1 | 8/2002 | Martling et al. | |
| 7,082,766 | B1 | 8/2006 | Widener et al. | |
| 8,118,549 | B2 | 2/2012 | Schiavo | |
| 8,418,474 | B2 | 4/2013 | Rizkalla et al. | |
| 8,434,313 | B2 | 5/2013 | Tschuor et al. | |
| 8,955,331 | B2 | 2/2015 | Moehrle et al. | |
| 9,435,535 | B2 | 9/2016 | Desai et al. | |
| 2002/0184892 | A1 | 12/2002 | Calvez et al. | |
| 2003/0106317 | A1* | 6/2003 | Jorgensen | F01D 9/023 60/722 |
| 2004/0118127 | A1 | 6/2004 | Mitchell et al. | |

(Continued)

FOREIGN PATENT DOCUMENTS

| | | | |
|---|---|---|---|
| EP | 3450851 | A1 | 3/2019 |

OTHER PUBLICATIONS

PCT Application No. PCT/US19/59383, International Search Report and Written Opinion, dated Jan. 24, 2020, 9 pages.

(Continued)

*Primary Examiner* — Scott J Walthour

(74) *Attorney, Agent, or Firm* — Avek IP, LLC

(57) ABSTRACT

A system for directing cooling air into a gas turbine combustor is provided. The system comprises a transition duct coupled to a flow sleeve, where air to be used for combustor cooling and in the combustion process enters a bellmouth of the transition duct, passes through a plurality of struts within the bellmouth, and is distributed to a passage located between the combustion liner and flow sleeve.

13 Claims, 7 Drawing Sheets

(56) References Cited

U.S. PATENT DOCUMENTS

| | | | | |
|---|---|---|---|---|
| 2004/0154303 | A1 | 8/2004 | Mitchell et al. | |
| 2004/0261419 | A1 | 12/2004 | McCaffrey et al. | |
| 2006/0271311 | A1 | 11/2006 | Gao et al. | |
| 2007/0119182 | A1 | 5/2007 | Czachor et al. | |
| 2007/0130958 | A1 | 6/2007 | Ohri et al. | |
| 2009/0101788 | A1 | 4/2009 | Kidder et al. | |
| 2009/0139238 | A1 | 6/2009 | Martling et al. | |
| 2010/0170257 | A1* | 7/2010 | Chila | F23R 3/04 60/754 |
| 2011/0089266 | A1 | 4/2011 | Stoia et al. | |
| 2011/0247193 | A1 | 10/2011 | Herbold | |
| 2012/0047909 | A1 | 3/2012 | Ghanime | |
| 2013/0086920 | A1* | 4/2013 | Chen | F23R 3/04 60/782 |
| 2013/0086921 | A1* | 4/2013 | Matthews | F23R 3/005 60/782 |
| 2013/0269359 | A1* | 10/2013 | Hughes | F23R 3/04 60/772 |
| 2014/0026851 | A1 | 1/2014 | Harmsen et al. | |
| 2014/0041391 | A1* | 2/2014 | DiCintio | F01D 9/023 60/752 |
| 2015/0107267 | A1 | 4/2015 | Cotton et al. | |
| 2015/0128609 | A1 | 5/2015 | Piersall et al. | |
| 2015/0184856 | A1 | 7/2015 | Stuttaford et al. | |
| 2018/0038594 | A1 | 2/2018 | Shibata | |
| 2018/0080650 | A1 | 3/2018 | Pucci et al. | |
| 2018/0355799 | A1 | 12/2018 | Terauchi et al. | |

OTHER PUBLICATIONS

Non-Final Office Action, dated Jan. 26, 2021, 10 pages, issued in U.S. Appl. No. 16/178,682.

Non-Final Office Action, dated Jun. 17, 2021, 14 pages, issued in U.S. Appl. No. 16/178,682.

Notice of Allowance, dated Oct. 6, 2021, 8 pages, issued in U.S. Appl. No. 16/178,682.

* cited by examiner

SYSTEM AND METHOD FOR PROVIDING COMPRESSED AIR TO A GAS TURBINE COMBUSTOR

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

This present disclosure relates generally to a system for improving airflow supply and distribution to a gas turbine combustor. More specifically, embodiments of the present disclosure relate to a reconfigured air flow inlet region between a transition duct and a flow sleeve of the gas turbine combustor.

BACKGROUND OF THE DISCLOSURE

A gas turbine engine typically comprises a multi-stage compressor coupled to a multi-stage turbine via an axial shaft. Air enters the gas turbine engine through the compressor where its temperature and pressure increase as it passes through subsequent stages of the compressor. The compressed air is then directed to one or more combustors where it mixes with a fuel source to create a combustible mixture. This mixture is ignited in the one or more combustors to create a flow of hot combustion gases. These gases are directed into the turbine causing the turbine to rotate, thereby driving the compressor. The output of the gas turbine engine can be mechanical thrust via exhaust from the turbine or shaft power from the rotation of an axial shaft, where the axial shaft can drive a generator to produce electricity.

In a typical industrial gas turbine engine, the combustor section comprises a plurality of can-annular combustors. In this arrangement, a plurality of individual combustors is arranged about the axis of the gas turbine engine. Each of the combustors typically comprises a combustion liner positioned within a flow sleeve and one or more fuel nozzles located at an inlet of the combustion liner. Compressed air passes between the flow sleeve and the combustion liner and along an exterior surface of the combustion liner prior to being mixed with fuel in the combustion liner. By directing compressed air over the combustion liner, the air cools the combustion liner and is pre-heated prior to combustion, resulting in a more efficient combustion process. The air from the engine compressor can also be used to cool a transition duct, which, as one skilled in the art understands, is used to direct hot combustion gases from the combustion liner to the turbine inlet.

In prior art combustion systems, a portion of the compressed air was injected into the passage between the combustion liner and flow sleeve through a series of injection ports in the flow sleeve. This prior art configuration is shown in FIG. 1 and includes a flow sleeve 100 having a plurality of openings 102 and injection ports or tubes 104. Positioned within the flow sleeve 100 is a combustion liner 106 which is coupled to a transition duct 108. The transition duct 108 includes an outer cooling sleeve 110. Air from the engine compressor enters a channel 112 formed between the transition duct 108 and the outer cooling sleeve 110 and flows along an outer wall of the transition duct 108 and an outer wall of the combustion liner 106, as indicated by the arrows in FIG. 1. The openings 102 and injection ports 104 of the flow sleeve 100 provide jets of cooling air aimed towards the combustion liner 106. This arrangement creates a cross flow of cooling air resulting in an adverse interaction between air entering through the openings 102 and injection ports 104 and air in the channel 112. As such, cooling of an aft end of the combustion liner is not as effective as desired.

BRIEF SUMMARY OF THE DISCLOSURE

The following presents a simplified summary of the disclosure to provide a basic understanding of some aspects thereof. This summary is not an extensive overview of the application. It is not intended to identify critical elements of the disclosure or to delineate the scope of the disclosure. Its sole purpose is to present some concepts of the disclosure in a simplified form as a prelude to the more detailed description that is presented elsewhere herein.

The present disclosure provides systems and methods for improving a flow of cooling air to a gas turbine combustion system, thereby providing a more uniform distribution of cooling air along a combustion liner.

In an embodiment of the disclosure, a transition duct for a gas turbine engine is provided and comprises an inlet ring, a duct body connected to the inlet ring, and an aft frame connected to the duct body. A bellmouth is positioned radially outward of the inlet ring and encompasses the inlet ring. A plurality of struts extends between the bellmouth and the inlet ring, where the struts have a leading edge, an opposing trailing edge, and a thickness. In this configuration, air for combustion in the gas turbine engine passes through the bellmouth, between the plurality of struts and is directed to a combustion system coupled to the transition duct.

In an alternate embodiment of the disclosure, a flow inlet device for a gas turbine combustor is provided. The flow inlet device comprises an inlet ring, a bellmouth positioned radially outward of and encompassing the inlet ring, and a plurality of struts extending between the inlet ring and the bellmouth. The inlet ring and the bellmouth direct air for use in the gas turbine combustor between the plurality of struts.

In yet another embodiment of the disclosure, a method of increasing airflow to a gas turbine combustor is provided. The method provides a transition duct for a gas turbine engine having an inlet ring, a duct body connected to the inlet ring, an aft frame connected to the duct body, a bellmouth positioned radially outward and encompassing the inlet ring, and a plurality of struts positioned between the bellmouth and the inlet ring, where the struts have a leading edge, an opposing trailing edge, and a thickness. A flow sleeve is coupled to the transition duct and a flow of air is directed through the bellmouth, between the plurality of struts, and towards an inlet of the gas turbine combustor.

The present disclosure is aimed at providing an improved way of directing cooling air into and along a gas turbine combustion system including improvements to various combustor hardware, such that overall cooling air distribution is improved.

These and other features of the present disclosure can be best understood from the following description and claims.

BRIEF DESCRIPTION OF THE SEVERAL VIEWS OF THE DRAWINGS

The present disclosure is described in detail below with reference to the attached drawing figures, wherein.

DETAILED DESCRIPTION

The present disclosure is intended for use in a gas turbine engine, such as a gas turbine used for aircraft engines and/or power generation. As such, the present disclosure is capable of being used in a variety of turbine operating environments, regardless of the manufacturer.

As those skilled in the art will readily appreciate, a gas turbine engine is circumferentially disposed about an engine centerline, or axial centerline axis. The engine includes a compressor, a combustion section and a turbine with the turbine coupled to the compressor via an engine shaft. As is well known in the art, air compressed in the compressor is mixed with fuel which is burned in the combustion section and expanded in turbine. For certain gas turbine engines, such as industrial gas turbines used in power generation, the combustion system comprises a plurality of interconnected can-annular combustion chambers with each combustion chamber directing hot combustion gases to a turbine inlet via a transition duct. The transition duct typically has a varying geometric profile in order to connect a cylindrical combustor to a portion of an annular turbine inlet.

Figure 2:
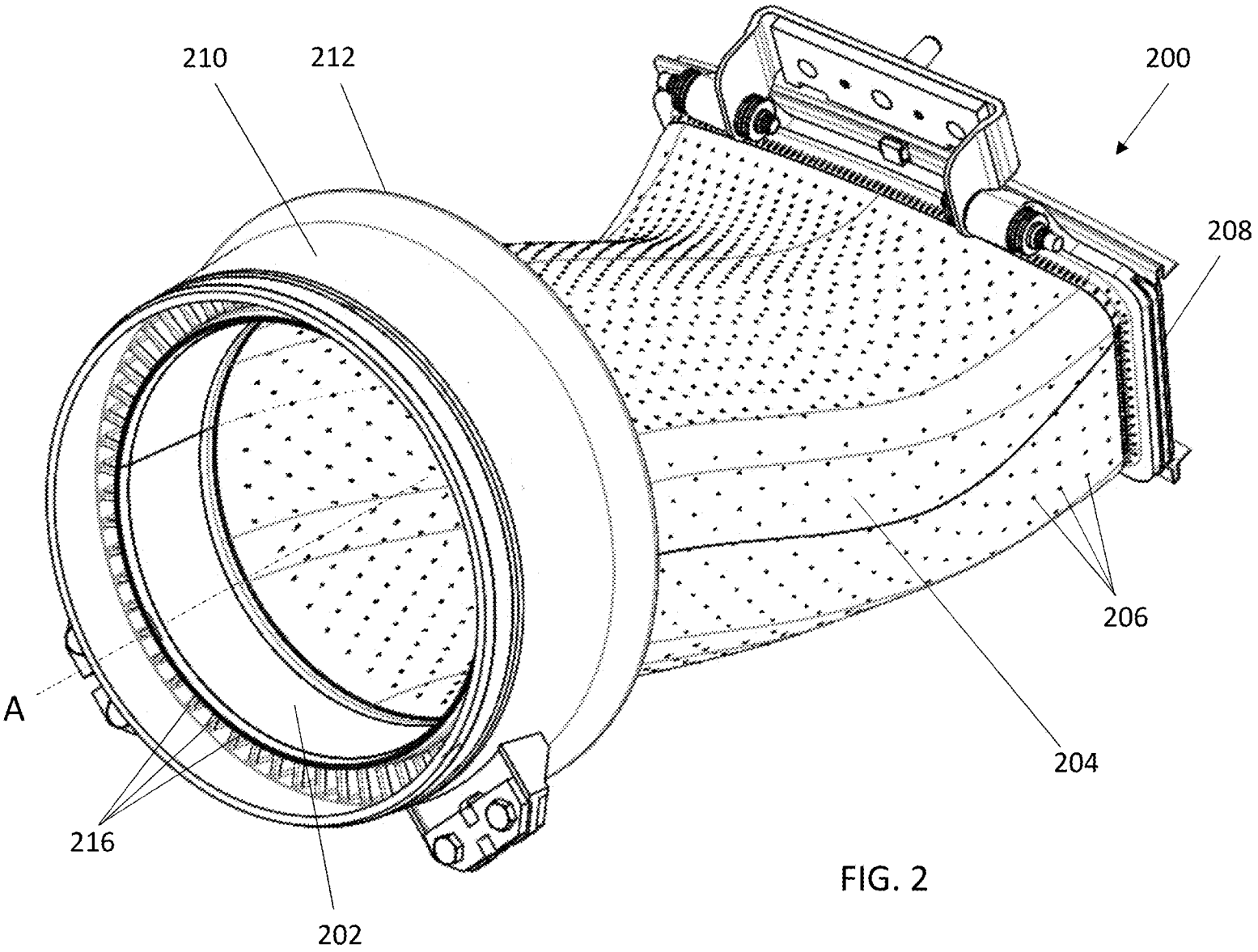
FIG. 2 is a perspective view of a transition duct of a gas turbine combustor in accordance with an embodiment of the present disclosure.

Various embodiments of the present disclosure are depicted in FIGS. 2-10. Referring initially to FIG. 2, a transition duct 200 capable of connecting a combustion liner to the turbine is provided. The transition duct 200 comprises an inlet ring 202 connected to a duct body 204, which together form a gas path profile for directing hot combustion gases to the turbine. The duct body 204 is typically actively cooled due to the operating temperatures of the transition duct 200. For the embodiment depicted in FIG. 2, a plurality of cooling holes 206 are placed in the duct body 204. The cooling holes 206 can vary in size, shape, orientation, and spacing in order to provide the required cooling flow to the duct body 204, as various surfaces of the duct body 204 will require different amounts of cooling air.

Connected to an opposite end of the duct body 204 is an aft frame 208. The aft frame 208 is formed in a shape corresponding to a portion of an inlet of the turbine section (not shown). For the transition duct 200, the inlet ring 202 is generally cylindrical, the aft frame is an arc-shaped rectangular opening, and the duct body 204 transitions between these two openings.

Figure 9:
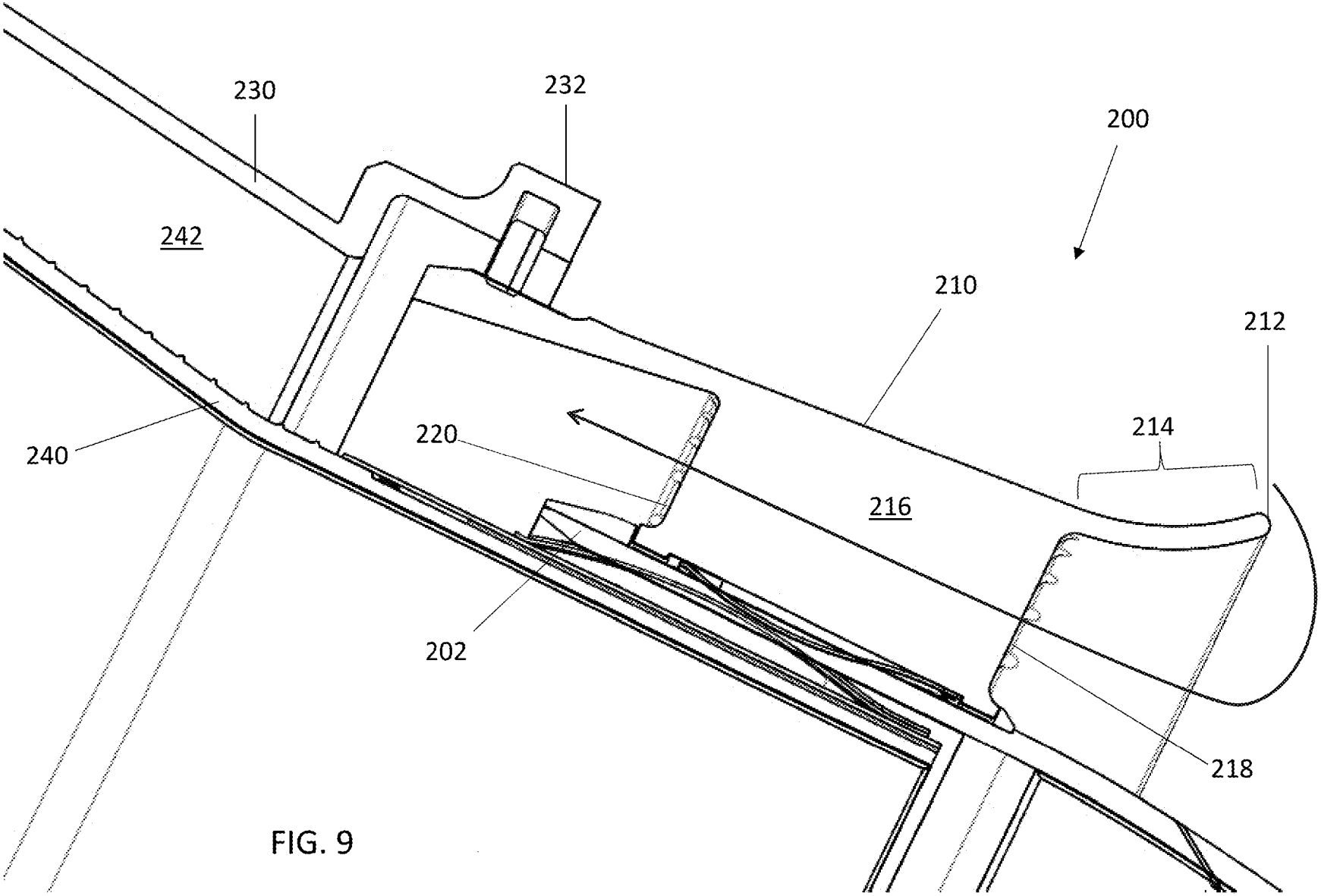
FIG. 9 is a partial cross section view of a transition duct, flow sleeve, and combustion liner in accordance with an embodiment of the present disclosure.
Figure 10:
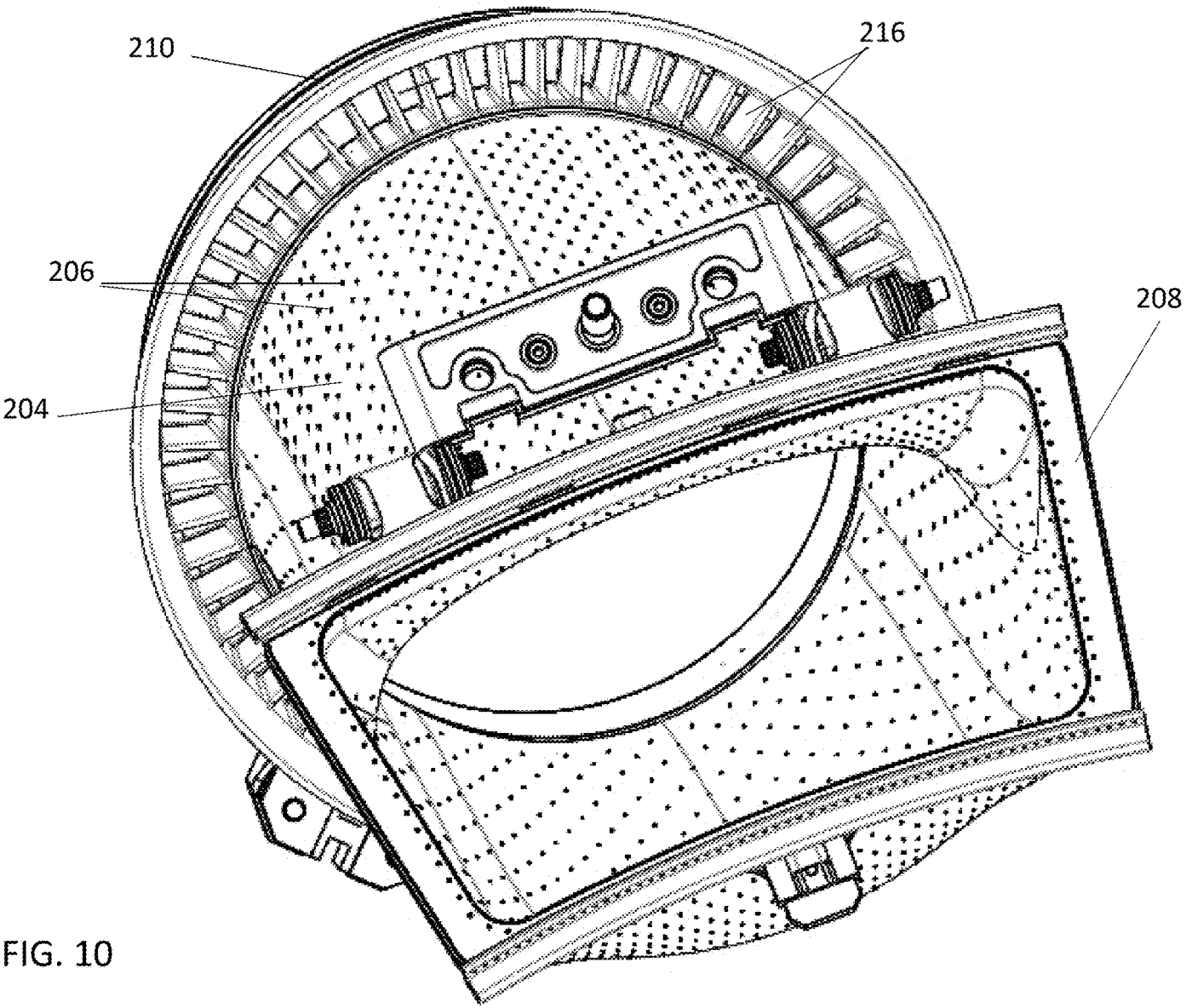
FIG. 10 is an alternate perspective view of a transition duct in accordance with an embodiment of the present disclosure.

Positioned radially outward of the inlet ring 202 and encompassing the inlet ring 202 is a bellmouth 210. The bellmouth 210 provides an inlet 212 through which cooling air is provided to the combustion system, as depicted in FIG. 9. That is, air for cooling and combustion passes through the bellmouth 210. The inlet 212 further encourages compressed air to enter the bellmouth 210 with a flared inlet 214. The flared inlet, which is flared outward and away from the bellmouth 210, helps to direct compressed air from the region around the duct body 204 and into bellmouth 210 by providing a wider opening to receive compressed air.

Extending radially between and attached to the inlet ring 202 and the bellmouth 210 is a plurality of struts 216. The assembly of the inlet ring 202, bellmouth 210, and plurality of struts 216 is secured to the duct body 204 and can be an integral assembly, such as a weldment, brazed joints, or an integral one-piece casting. Each of struts 216 further comprises a leading edge 218, an opposing trailing edge 220, and a body 222 having a thickness therebetween. The leading edge 218 of strut 216 is located towards the flared inlet 214. Since the struts 216 are positioned in a region of relatively cool air, and therefore do not need to be cooled, the struts 216 are solid. However, in an alternate configuration of the disclosure, the struts 216 can be hollow in order to reduce weight or should it be desired to inject a fluid through the struts.

Figure 4:
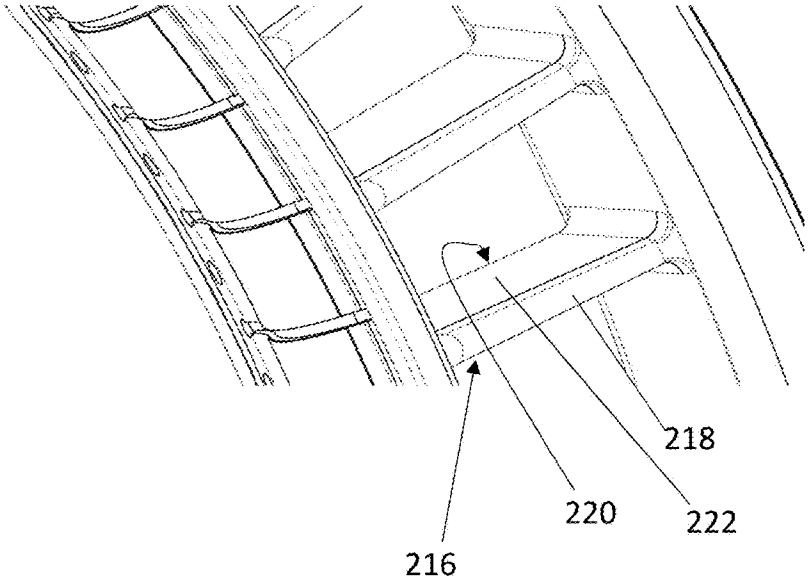
FIG. 4 is a detailed perspective view of a portion of the transition duct of FIG. 3 in accordance with an embodiment of the present disclosure.
Figure 3:
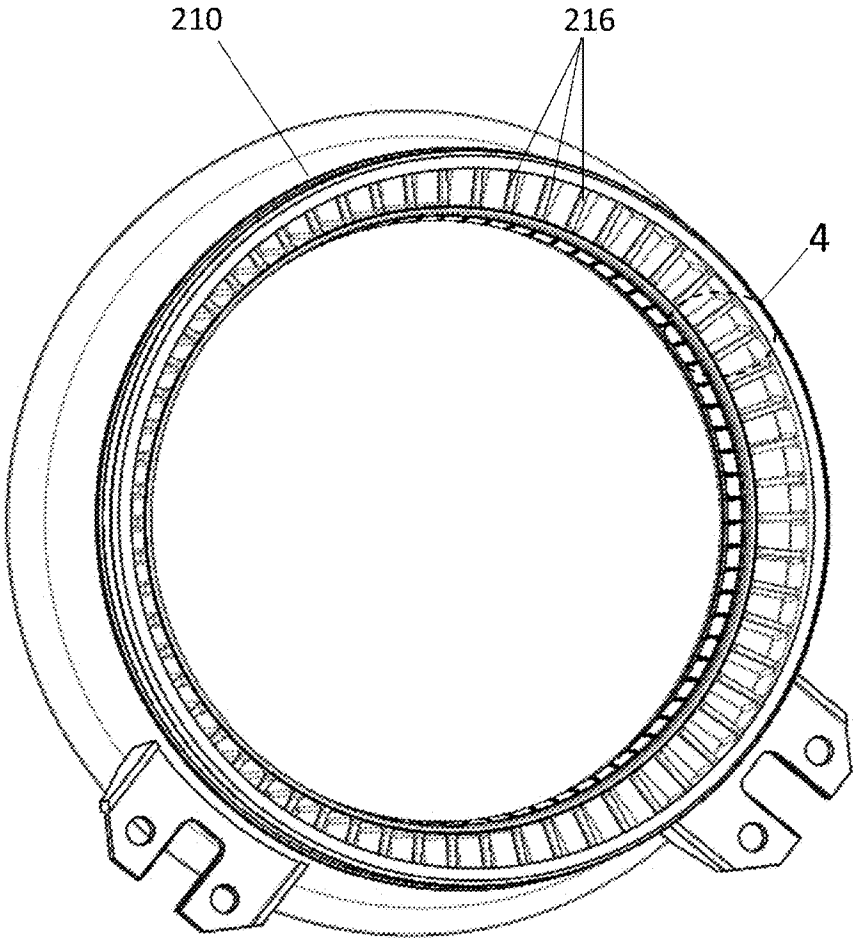
FIG. 3 is an alternate perspective view of the transition duct of FIG. 2 in accordance with an embodiment of the present disclosure.
Figure 5:
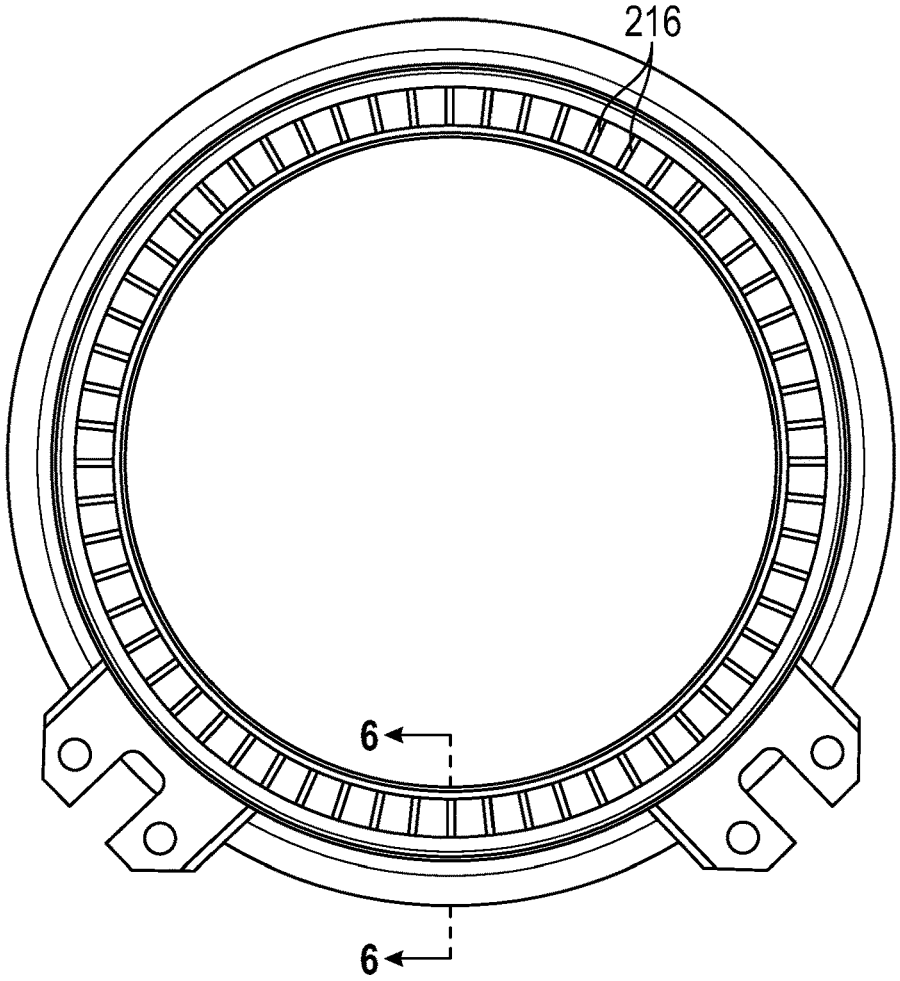
FIG. 5 is an elevation view of the transition duct of FIG. 2 in accordance with an embodiment of the present disclosure.
Figure 6:
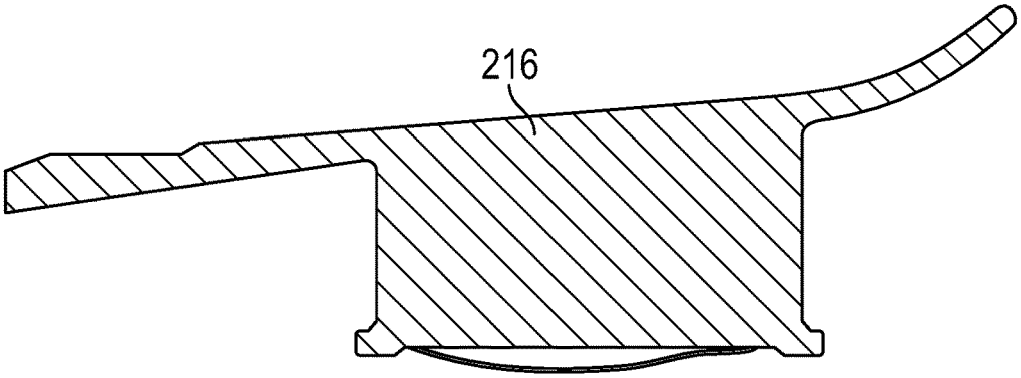
FIG. 6 is a partial cross section view of the transition duct of FIG. 5 in accordance with an embodiment of the present disclosure.
Figure 8:
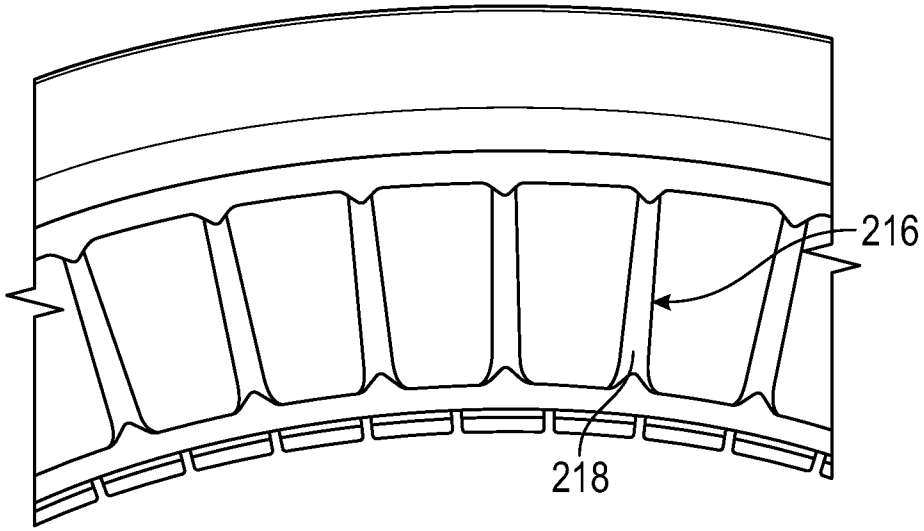
FIG. 8 is a partial cross section view of the transition duct of FIG. 7 in accordance with an embodiment of the present disclosure.
Figure 7:
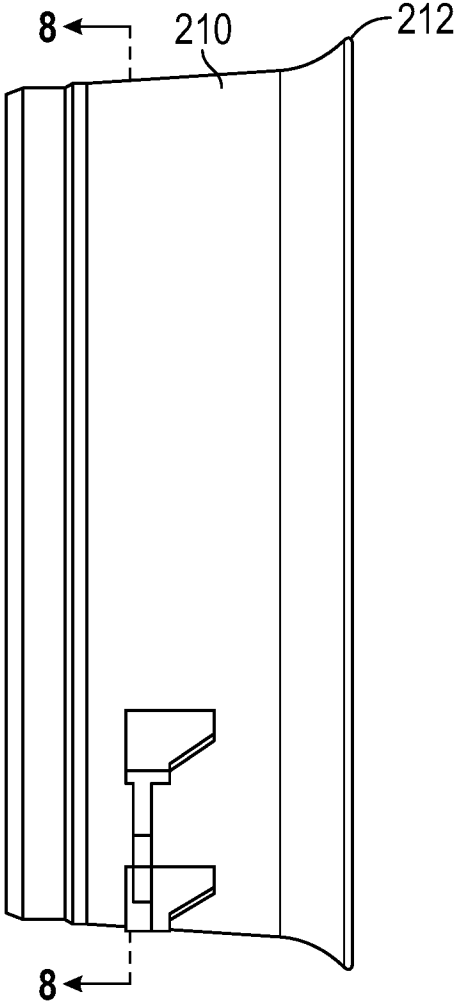
FIG. 7 is an elevation view of a portion of the transition duct of FIG. 2 in accordance with an embodiment of the present disclosure.

The configuration of the struts 216 can vary depending on specific engine and combustor operating conditions. For example, in an embodiment of the disclosure, the plurality of struts 216 have a rounded leading edge 218 and a rounded trailing edge 220 with a constant thickness to the strut 216 therebetween. This configuration is depicted in FIG. 4. In an alternate embodiment of the disclosure, the leading edge 218 can be rounded, with the thickness of the strut tapering so that the trailing edge 220 is thinner than the leading edge 218. In yet another embodiment of the present disclosure, the thickness of the struts 216 taper to a reduced thickness proximate the leading edge 218 and the trailing edge 220.

For the embodiment of the disclosure depicted in FIGS. 2-10, the plurality of the struts 216 are oriented generally parallel with respect to an axis A-A. That is, the air flow enters the inlet 212, passes through the struts 216 and then flows in a direction generally parallel to the orientation of the struts 216. This air exits the bellmouth 210, cools a combustion system, and is injected into the combustion liner where it is used in a combustion process. In an alternate embodiment, the plurality of struts 216 can be oriented at an angle relative to the axis A-A extending through the inlet ring 202, thus imparting a swirl to the airflow passing between the struts 216. In a further embodiment of the disclosure, the struts 216 can be curved where each of the struts 216 have an airfoil-like cross sectional shape, which can also be used to impart a swirl to the airflow.

In addition to the directional orientation of the struts 216, the quantity and spacing of the struts 216 between the inlet ring 202 and bellmouth 210 can also vary. In the embodiment of the disclosure depicted in FIGS. 2-10, the plurality of struts 216 are equally spaced about the perimeter of the inlet ring 202. However, in alternate configurations, the spacing between the struts 216 can be non-uniform. For example, depending on the flow of compressed air into the inlet 212 and desired distribution of cooling flow, one configuration may include large gaps between struts 216 or certain regions having struts 216 removed. Such larger gaps between struts 216 can permit more air to flow through these regions, thus increasing cooling flow to certain areas around the combustor.

The bellmouth 210 is described herein as an integral part of the transition duct 200. However, it is to be understood that the bellmouth 210 could also be a separate component attached to the transition duct 200. Where a separate bellmouth is used, the bellmouth can be attached to the inlet of a transition duct by a slip fit including a spring between the inner diameter of bellmouth and an outer diameter of the transition duct.

The present disclosure also provides a method of increasing airflow to a gas turbine combustor. Accordingly, a transition duct 200 having an inlet ring 202, a duct body 204 connected to the inlet ring 202, and an aft frame 208 connected to the duct body 204 is provided. The duct body 204 also comprises a bellmouth 210 positioned radially outward of and encompassing the inlet ring 202 and a plurality of struts 216 positioned between the bellmouth 210 and the inlet ring 202. Referring now to FIG. 9, a flow sleeve 230 is provided and coupled to the transition duct 200, such that the bellmouth 210 engages a flow sleeve aft end 232. A combustion liner 240 engages the inlet ring 202 of the transition duct 200, thereby forming a passage 242 between the combustion liner 240 and the flow sleeve 230.

In operation, a flow of air from the engine compressor is provided to a compressor discharge plenum (not shown). This air can serve to cool the transition duct 200 and is then directed into the bellmouth 210 at inlet 212, where it passes between struts 216, which serve to properly orient and distribute the flow of compressed air in the passage 242. This air flow then continues through the passage 242, along an outer surface of the combustion liner 240, and to an inlet of the combustor.

Figure 1:
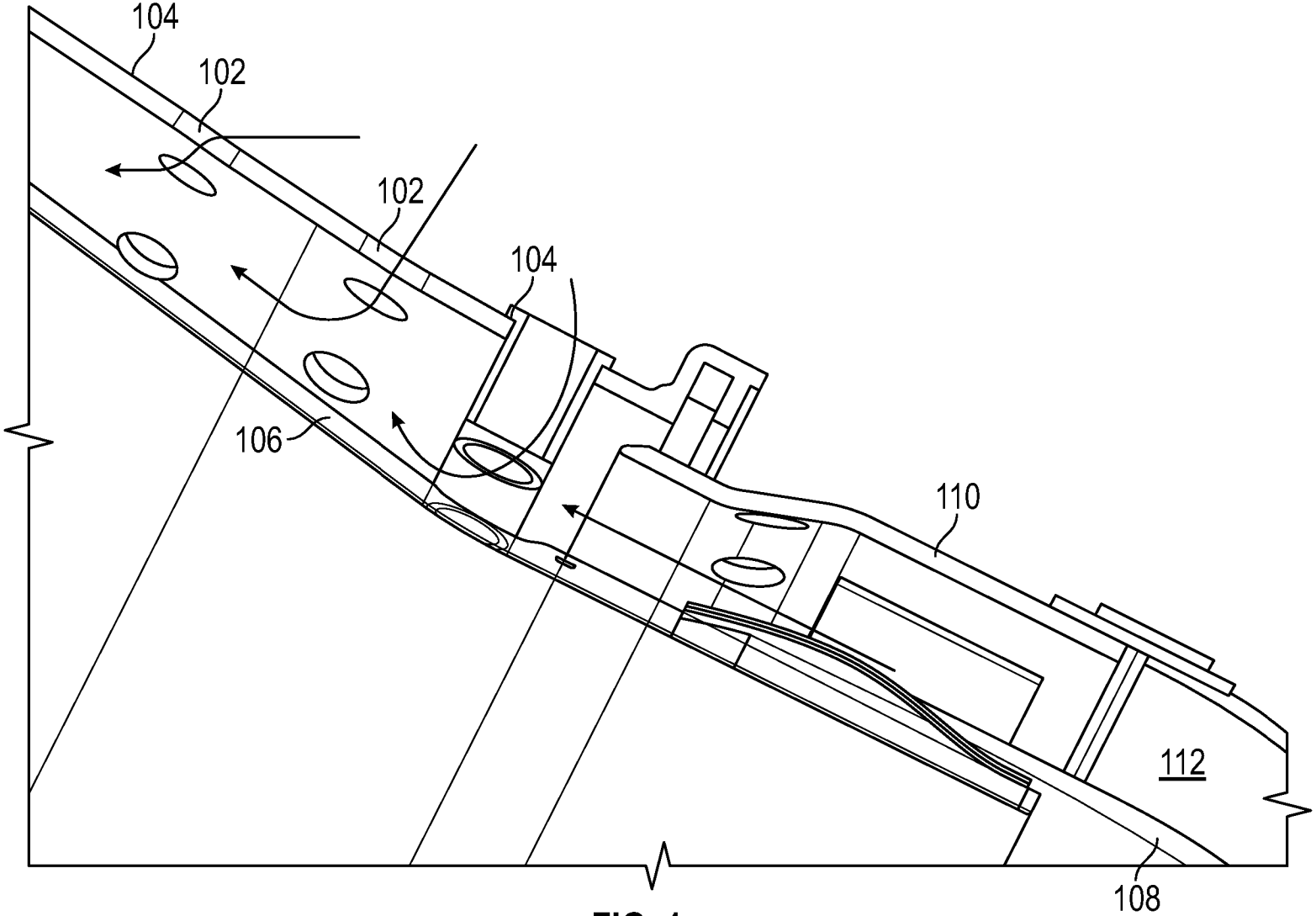
FIG. 1 (Prior Art)
FIG. 1 is a cross section view of a portion of a gas turbine combustor in accordance with the prior art.

As a result of the bellmouth 210 and the plurality of struts 216 coupled to the inlet ring 202, air for cooling the combustion liner 240 is more evenly distributed along an outer surface of the combustion liner 240, thereby eliminating the need for the openings 102 and injector ports 104 in the flow sleeve of the prior art of FIG. 1. Eliminating these openings and injector ports in the flow sleeve allows for a further reduction of pressure drop across the combustion system and avoids cross-flow of different cooling air flows as seen in the prior art and other combustor designs. The airflow is also more evenly distributed to the inlet of the combustor, which will improve combustion efficiency and reduce combustion dynamics.

Although a preferred embodiment of this disclosure has been provided, one of ordinary skill in this art would recognize that certain modifications would come within the scope of this disclosure. For that reason, the following claims should be studied to determine the true scope and content of this disclosure. Since many possible embodiments may be made of the disclosure without departing from the scope thereof, it is to be understood that all matter herein set forth or shown in the accompanying drawings is to be interpreted as illustrative and not in a limiting sense.

From the foregoing, it will be seen that this disclosure is one well adapted to attain all the ends and objects hereinabove set forth together with other advantages which are obvious, and which are inherent to the structure.

It will be understood that certain features and subcombinations are of utility and may be employed without reference to other features and subcombinations. This is contemplated by and is within the scope of the claims.

What is claimed is:

1. A method of increasing airflow to a gas turbine combustor comprising:

providing a transition duct for a gas turbine engine, the transition duct comprising an inlet ring, a duct body connected to the inlet ring, an aft frame connected to the duct body, a bellmouth positioned radially outward of and encompassing the inlet ring, the bellmouth having a flared inlet, the flared inlet having a curved inner surface, a curved outer surface opposing the curved inner surface, and a curved outer edge connecting the curved inner surface and the curved outer surface, wherein both the curved inner surface and the curved outer surface curve away from the inlet ring, and a plurality of struts extending from the bellmouth to the inlet ring, the plurality of struts having a leading edge, an opposing trailing edge, and a body having a thickness;

engaging a combustion liner and the inlet ring;

coupling the bellmouth to an end of a flow sleeve;

directing a flow of air through the bellmouth and between the plurality of struts and to an inlet of the gas turbine combustor; and directing hot combustion gases to a turbine through a pathway formed collectively by the inlet ring and the duct body.

2. The method of claim 1, wherein the inlet ring, the plurality of struts, and the bellmouth are an integral assembly.

3. The method of claim 2, wherein the integral assembly is a casting.

4. The method of claim 1, further comprising directing the flow of air over an outer surface of the combustion liner.

5. A combustion system for a gas turbine engine, the combustion system comprising:

a combustion liner;

a flow sleeve; and a transition duct, the transition duct comprising:

an inlet ring;

a duct body connected to the inlet ring;

an aft frame connected to the duct body;

a bellmouth positioned radially outward of and encompassing the inlet ring, the bellmouth having a body portion and a flared inlet adjacent the body portion, the flared inlet having a curved inner surface, a curved outer surface opposing the curved inner surface, and a curved outer edge connecting the curved inner surface and the curved outer surface, wherein both the curved inner surface and the curved outer surface curve away from the inlet ring; and, a plurality of struts extending continuously from the body portion to the inlet ring, the struts having a rounded leading edge, an opposing trailing edge, and a tapering body, a thickness of the leading edge being greater than a thickness of the trailing edge, wherein:

the inlet ring engages the combustion liner;

the body portion is coupled to an end of the flow sleeve; and the duct body and the inlet ring collectively define a pathway configured to direct hot combustion gases to a turbine.

6. The combustion system of claim 5, wherein the bellmouth terminates at the flared inlet.

7. The combustion system of claim 5, wherein the inlet ring, the bellmouth, and the plurality of struts are an integral assembly.

8. The combustion system of claim 5, wherein the plurality of struts is oriented parallel with respect to an axis extending through the inlet ring.

9. The combustion system of claim 5, wherein the plurality of struts is oriented at an angle relative to an axis extending through the inlet ring.

10. The combustion system of claim 5, wherein the plurality of struts is equally spaced about a perimeter of the inlet ring.

11. The combustion system of claim 5, wherein a distance between the plurality of struts is unequal.

12. The combustion system of claim 5, wherein a length of the inlet ring is less than a length of the bellmouth.

13. The combustion system of claim 5, further comprising a plurality of cooling holes in the duct body.

* * * * *